US008074742B2

(12) United States Patent
Scott et al.

(10) Patent No.: US 8,074,742 B2
(45) Date of Patent: Dec. 13, 2011

(54) APPARATUS AND METHOD FOR CUTTING A WELLBORE

(75) Inventors: Edward D. Scott, Cardenden (GB); Lance S. Davis, Aberdeen (GB)

(73) Assignee: Deep Casing Tools, Ltd., Aberdeen (GB)

( * ) Notice: Subject to any disclaimer, the term of this patent is extended or adjusted under 35 U.S.C. 154(b) by 0 days.

(21) Appl. No.: 13/072,052

(22) Filed: Mar. 25, 2011

(65) Prior Publication Data

US 2011/0180326 A1 Jul. 28, 2011

Related U.S. Application Data

(63) Continuation of application No. PCT/GB2009/000003, filed on Jan. 5, 2009.

(30) Foreign Application Priority Data

Sep. 30, 2008 (GB) ..... 0817882.4

(51) Int. Cl.
*E21B 7/08* (2006.01)

(52) U.S. Cl. ..... 175/57; 175/107; 175/257

(58) Field of Classification Search ..... 175/57, 175/107, 257

See application file for complete search history.

(56) References Cited

U.S. PATENT DOCUMENTS

| | | | | |
|---|---|---|---|---|
| 2,679,615 | A | 11/1956 | Burgess | |
| 5,038,873 | A * | 8/1991 | Jurgens | 175/246 |
| 5,098,258 | A | 3/1992 | Barnetche-Gonzalez | |
| 5,518,379 | A | 5/1996 | Harris et al. | |
| 6,896,075 | B2 * | 5/2005 | Haugen et al. | 175/57 |
| 2004/0118611 | A1 * | 6/2004 | Runia et al. | 175/57 |

FOREIGN PATENT DOCUMENTS

| | | | |
|---|---|---|---|
| CA | 1181739 | A | 1/1985 |
| EP | 1988252 | A2 | 11/2008 |
| GB | 2100321 | A | 12/1982 |
| SU | 1761938 | A1 | 9/1992 |
| WO | 95/19488 | A | 7/1995 |
| WO | 99/57416 | A | 11/1999 |
| WO | 2004/027211 | A1 | 4/2004 |

OTHER PUBLICATIONS

International Search Report, Application No. PCT/GB2009/000003.
Search Report, GB patent application No. 0817882.4.

* cited by examiner

*Primary Examiner* — William P Neuder
(74) *Attorney, Agent, or Firm* — Richard A. Fagin

(57) ABSTRACT

An apparatus for cutting a wellbore includes a motor with a stator and a rotor. The rotor includes an output shaft connected to a cutting structure to drive the cutting structure in use. The stator and rotor are spaced radially outwardly of the axis of the rotor such that at least one of the stator and the rotor has an access bore that extends through the motor to a position adjacent the cutting structure and through which a further object can pass without obstruction from the stator and rotor. The further object includes a further cutting structure. The motor workings are radially outward of the output shaft and the further cutting structure so as not to obstruct passage of the further cutting structure toward the cutting structure, such that the motor workings do not require drilling or removal to allow the further cutting structure access to the cutting structure.

20 Claims, 4 Drawing Sheets

APPARATUS AND METHOD FOR CUTTING A WELLBORE

CROSS-REFERENCE TO RELATED APPLICATIONS

Continuation of International Application No. PCT/GB2009/000003 filed on Jan. 5, 2009. Priority is claimed from British Patent Application No. 0817882.4 filed on Sep. 30, 2008.

STATEMENT REGARDING FEDERALLY SPONSORED RESEARCH OR DEVELOPMENT

Not Applicable

BACKGROUND OF THE INVENTION

The present invention relates to an apparatus and method for cutting a wellbore particularly but not exclusively for accessing sub-surface hydrocarbon bearing earth formations.

In the oil and gas production industry wellbores are drilled from the earth's surface to access sub-surface hydrocarbon bearing formations. The wellbores are typically lined with a string of metal tubulars known as casing. The exterior of the casing is typically held in place in the wellbore using a bonding material such as cement.

It is usually the case that a drill and drill string is used to drill the initial wellbore. A 'trip out' process is then required where the drill and drill string are removed from the wellbore and the casing is subsequently run into the wellbore. A reamer shoe may be positioned at the lowermost end of the casing so as to ream the drilled wellbore as the casing is run in. The reamer shoe may be driven by rotating the casing itself, if this is possible, or may be driven by a motor at the bottom of the casing. In the latter case, the reamer shoe and motor need to subsequently be removed prior to further sections of casing being inserted. Further sections of casing are usually required for deeper wellbore sections, and these are run in through the initial section of casing after a further drilling process has occurred, the further drilling process requiring a drill and drill string to be run in through the initial section of casing.

Likewise when drilling an initial wellbore it can be desirable to be able to use multiple drilling operations in as quick succession as possible.

The repeated cycles of drilling and/or reaming steps are time consuming particularly in terms of the trip out and run in processes associated with removing and reinserting the drill and drill string and/or reamer shoes and associated motors.

Our earlier international patent application PCT/GB2007/002874 discloses a solution to these problems wherein the reamer shoe and a motor are positioned at the lower end of the casing and have sacrificial components that are arranged to be readily drilled out using a drill and drill string subsequently inserted into the casing. This removes the necessity for a trip out process associated with the reamer shoe and motor prior to subsequent drilling.

Whilst the apparatus and method described in our above mentioned earlier international application provide significant time and therefore cost savings over previous proposals, there is a need to further reduce the time taken, as the process wherein the motor and reamer shoe are drilled through may still take longer than desired.

SUMMARY OF THE INVENTION

According to a first aspect of the invention there is provided an apparatus for cutting a wellbore, the apparatus comprising a motor provided with a stator and a rotor, the rotor being connected to a cutting structure so as to drive the cutting structure in use, wherein the stator and rotor are spaced radially outwardly of the axis of rotation of the rotor such that at least one of the stator and the rotor is formed with an access bore that extends through the motor to a position adjacent the cutting structure and through which, in use, a further object can pass, without obstruction from the stator and rotor. Preferably the access bore extends substantially the length of the motor.

Preferably the access bore is coaxial with the axis of rotation of the rotor.

Preferably the access bore extends across substantially 80% of the diameter of the apparatus, when the apparatus is viewed in transverse cross section, the motor thus being located in the radially outermost 20% of the apparatus.

The cutting structure may be a sacrificial cutting structure. In this instance it is envisaged that the further object may be a further cutting structure operative to cut through the sacrificial cutting structure.

The further object may comprise a position sensing device operative to transmit a signal indicative of the position of the cutting structure relative to the earth's surface.

The further object may alternatively comprise a sensing device operative to transmit a signal indicative of physical parameters of the cutting structure, the cutting process or the earth formation. The further object could alternatively be mechanical equipment such as a drill pipe, casing, sand-screens or other completion equipment to be used in deeper sections of the wellbore.

Preferably the motor is arranged so as to be entirely positioned, in use, and when viewed in transverse cross section, between the exterior of the access bore and the interior of the wellbore.

Preferably the outer margin of the motor is substantially flush with the outer margin of a tubular on which it is mounted in use. The tubular may for example be part of a drill string, or part of a casing that lines the wellbore.

Preferably the motor is substantially cylindrical.

Preferably the rotor of the motor comprises an output shaft connected to the cutting structure.

The output shaft may be integral with the cutting structure.

In one embodiment the output shaft is preferably concentric with, but radially outward of the stator. In this embodiment the access bore may be formed in the stator.

In another embodiment the output shaft is concentric with, but radially inward of the stator. In this embodiment the access bore may be formed in the output shaft.

Preferably the motor is adapted to be driven using drilling fluid pumped down the wellbore.

Most preferably the motor comprises a turbine arrangement comprising fluid engaging blades on at least the rotor to convert the fluid flow of the drilling fluid into rotation of the rotor.

The motor may be connected to a lower part of a drill string, the cutting structure then comprising a drill bit. This may be appropriate wherein the apparatus is used to drill a wellbore prior to any casing application.

The motor may be connected to a lower part of a casing, the cutting structure comprising a reamer shoe or a drill bit. This may be appropriate where the apparatus is used to ream or drill a wellbore subsequent to, or during any casing application. Thus the cutting structure may comprise a drill bit at the lowermost end of a casing, the drill bit being used to drill the bore as the casing is run in.

The cutting structure may comprise a coring tool operative to cut a core from the material being cut, the core comprising the further object that passes through the access bore in use of the apparatus.

Preferably the coring tool is annular in structure, the coring tool comprising a through passageway that is contiguous in use with the access bore of the motor.

In this embodiment, the core obtained suffers no noticeable damage and can therefore be used as a sample of the material being cut for subsequent analysis.

According to a second aspect of the invention there is provided a method for cutting a wellbore, the method comprising steps of driving an apparatus into a well bore or into a section of earth where a wellbore is required, controlling a motor of the apparatus to rotate a rotor of the motor connected to a cutting structure so as to drive the cutting structure into the earth to a desired depth, wherein the stator and rotor of the motor are spaced radially outwardly of the axis of rotation of the rotor such that at least one of the stator and the rotor is formed with an access bore that extends through the motor to a position adjacent the cutting structure, and passing a further object through the access bore.

Other aspects of the present invention may include any combination of the features or limitations referred to herein.

BRIEF DESCRIPTION OF THE DRAWINGS

The present invention may be carried into practice in various ways, but embodiments will now be described by way of example only with reference to the accompanying drawings in which.

DETAILED DESCRIPTION

Figure 1:
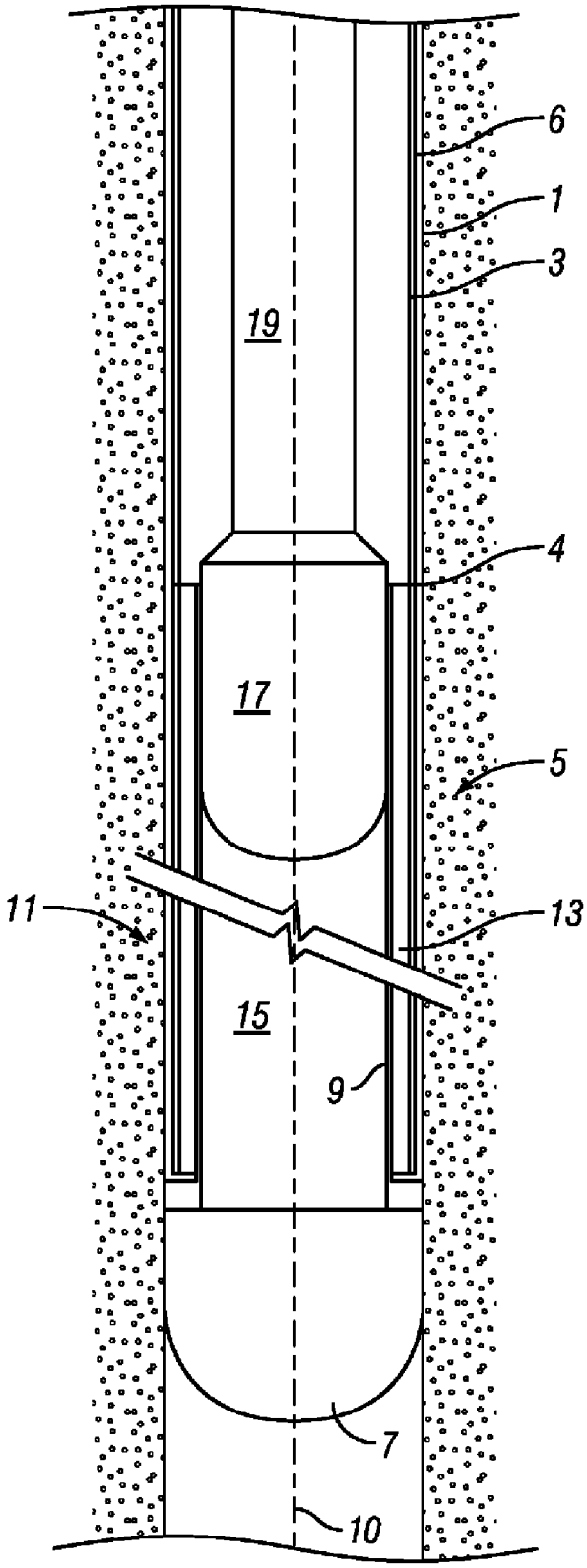
FIG. 1 is a sectional side view of an apparatus in accordance with the present invention.

Referring initially to FIG. 1, a wellbore 1 has been formed by an initial drilling operation. The wellbore 1 is being or already has been lined with a string of metal tubulars in the form of casing 3 having a lowermost end 4. An annular void 6 is defined between the outer surface of the casing 3 and the wall of the wellbore 1. The void 6 is typically filled with concrete once drilling and reaming operations are complete.

An apparatus 5 in accordance with the present invention comprises a cutting structure which, in this example, is a reamer shoe 7 connected to an output shaft 9, rotation of the output shaft 9 rotating the reamer shoe 7. In this example the cutting structure can be sacrificed.

The output shaft 9 comprises a rotor of a motor generally indicated 11, the rotor in this example being radially inward of a radially outward stator 13 fixedly connected to the lowermost end 4 of the casing 3.

The stator 13 is concentric with and extends around the periphery of the output shaft 9 and is thus of hollow tubular form when viewed from the side or in transverse cross section. The stator 13 is therefore radially spaced from the rotational axis 10 of output shaft 9 such that it does not, when viewed in cross section from the side, extend across the output shaft 9. The output shaft 9 is formed with an access bore 15 that extends along the length of the motor 11 from the reamer shoe 7 to the opposite, distal end of the output shaft 9, that is the end adjacent the lowermost end 4 of the casing 3. The access bore 15, in this example, is co-axial with the axis of rotation 10 of the output shaft 9. The access bore 15 may extend in a direction aligned with but not co-axial with, the axis 10.

The access bore 15 is dimensioned to receive a further object and is arranged such that the further object can be located directly adjacent the reamer shoe 7.

The further object could comprise any desired device which may include, for example, a sensing device to transmit a signal indicative of physical parameters relevant to the cutting process. However, in this example, the further object comprises a further cutting structure comprising a drill bit 17 connected to a drill pipe or string 19.

In use of the apparatus 5, the casing 3 is run into the predrilled wellbore 1. The motor 11 is activated to drive the output shaft 9 to rotate the reamer shoe 7 as is described in our earlier international patent application PCT/GB2007/002874, the reamer shoe 7 aiding running of the casing 3 into the wellbore 1.

Once the casing 3 has reached the desired depth, the motor 11 is deactivated.

The drill bit 17 and drill string 19 are then run into the casing 3. When the drill bit 17 reaches the lowermost end 4 of the casing 3, the drill bit 17 is run into the access bore 15 of the output shaft 9 so as to effectively pass through the interior of the motor 11, ie the motor workings are radially outward of the output shaft 9 and drill bit 17 and do not obstruct passage of the drill bit 17 toward the reamer shoe 7. The motor workings do not therefore require drilling out or removal to allow the drill bit 17 access to the reamer shoe 7.

Figure 2:
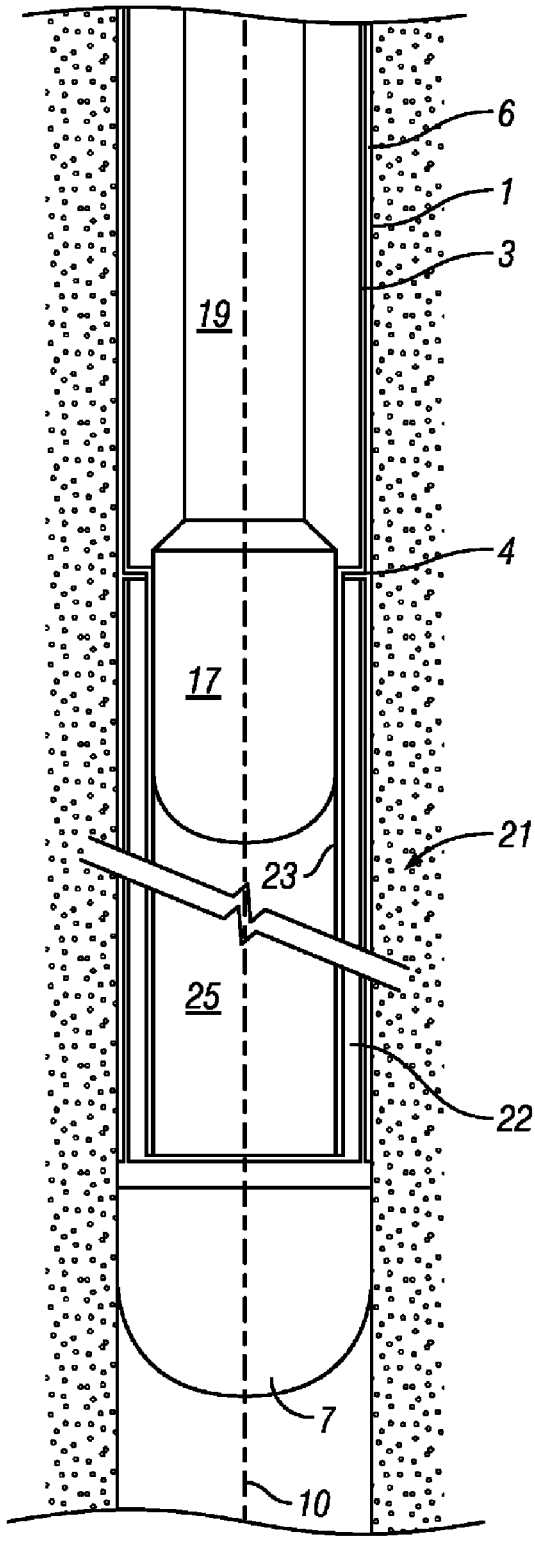
FIG. 2 is a sectional side view of a modified apparatus in accordance with the present invention.

When the drill bit 17 reaches the reamer shoe 7, rotation of the drill bit 17 allows the drill bit 17 to cut through the sacrificial reamer shoe 7 so as to project beyond the reamer shoe 7 so as to move into contact with material to be drilled through to form a subsequent section of wellbore. Referring to FIG. 2 a modified apparatus 21 is shown with like features being given like references to the apparatus 5 described above.

In this embodiment a modified output shaft 22 is concentric with but radially outward of the motor stator. In this embodiment the motor stator comprises a radially inward tubular stator 23 fixed to the lowermost end 4 of the casing 3. The tubular stator 23 is formed with an access bore 25 that extends from the reamer shoe 7 to the lowermost end 4 of the casing 3 co-axially with the axis of rotation 10 of the modified output shaft 22. The further object, which in this example again comprises the drill bit 17 and drill pipe 19, is run into the access bore 25 in the tubular stator 23 rather than the access bore 15 formed in the output shaft rotor 9 of the apparatus 5 of FIG. 1.

Figure 3:
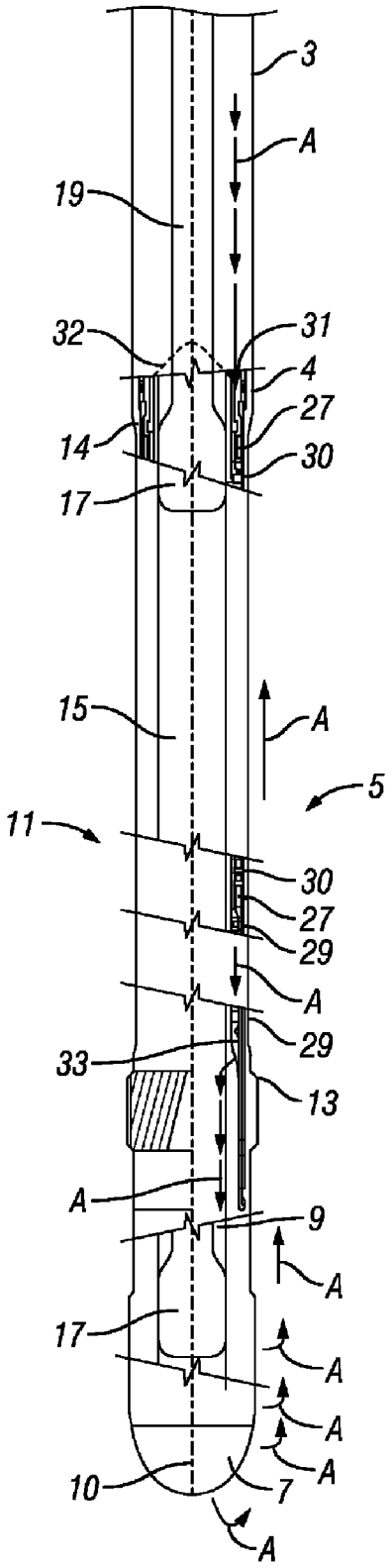
FIG. 3 is a more detailed part sectional, part cut away side view of the apparatus of FIG. 1 showing a further cutting structure in two consecutive positions, with part of the apparatus in phantom.

Referring to FIG. 3 a flared portion 14 of the radially outward stator 13 is locked to the interior surface of the lowermost end 4 of the casing 3. This can be achieved using any suitable locking means.

The radially inward output shaft rotor 9 is rotatably mounted on the stator 13 using a suitable combination of rotational bearings 27. Additionally a plurality of thrust bearings 29 are provided to limit axial movement between the rotor 9 and the stator 13 whilst still allowing relative rotation of these components. The thrust bearings 29 can be arranged to allow limited axial movement if desirable.

Any desired type, number and position of bearings may be used as required to deal with the loads generated.

The motor rotor 9 and stator 13 can comprise any desired structure and components to generate power to rotationally drive the rotor 9. However, in this example, the rotor 9 and stator 13 together comprise a turbine arrangement wherein the rotor 9 comprises turbine blades 30 arranged to deflect fluid pumped between the rotor 9 and stator 13 so as to convert some of the energy of the fluid into rotation of the rotor 9 and hence the reamer shoe 7.

The stator 13 comprises a fluid inlet 31 between the external stator 13 and the internal rotor 9, at the lowermost end 4 of the casing 3, the fluid inlet 31 being radially outwardly spaced from the axis 10.

A flow diverter 32 (shown in phantom) is provided adjacent the fluid inlet 31 and serves to divert fluid pumped down the casing 3 radially outwardly so as to flow into the fluid inlet 31.

The fluid flow path is indicated by arrows 'A'. Having been diverted by the flow diverter, the fluid enters the inlet 31 adjacent the lowermost casing end 4. The fluid is pumped in a direction generally parallel to the axis of rotation 10 of the rotor 9 in the void defined between the concentric rotor 9 and stator 13, and subsequently exits the void and the turbine arrangement radially inwardly through the outlet 33 into the access bore 15. The fluid then travels along the access bore 15 and subsequently generally radially outwardly and/or downwardly through jetting apertures (not shown) formed in the reamer shoe 7. The fluid thus functions as a lubricant for the reamer shoe 7 before being forced up the annular void 6 between the casing 3 and the wellbore 1.

It is envisaged that the fluid would preferably be a mud slurry comprising the drilling fluid used normally to lubricate the cutting structure.

Figure 4:
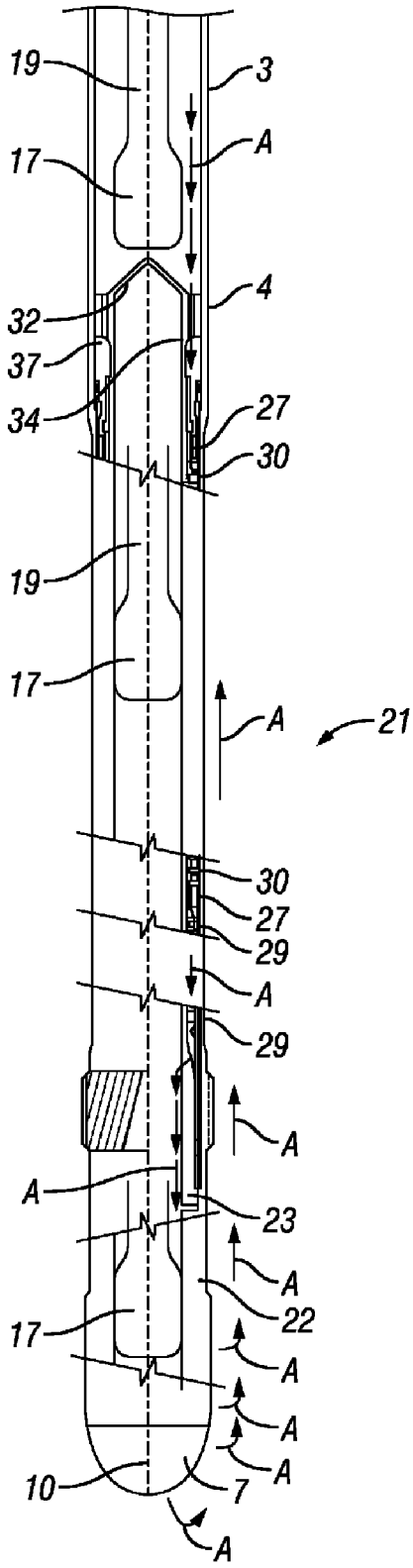
FIG. 4 is a more detailed part sectional, part cut away side view of the modified apparatus of FIG. 2 showing a further cutting structure in three consecutive positions.

Referring additionally to FIG. 4, a flared portion 34 of the radially inward stator 23 of the second described apparatus 21 is locked to the interior surface of the lowermost end 4 of the casing 3. This can again be achieved using any suitable locking means.

A seal 37 is provided adjacent the flared portion 34 of the stator 23 to resist fluid leakage between the radially outward output shaft rotor 22 and the lowermost end 4 of the casing 3. In this example the seal 37 comprises a rotating elastomeric seal, although any suitable seal could be used.

The bearings, turbine arrangement and fluid flow path are otherwise similar to those described above with reference to FIG. 3 and the apparatus 5.

In each embodiment it is envisaged that the bearings could be lubricated by the fluid used to drive the turbine arrangement.

In each embodiment it is envisaged that the rotor of the motor could be integral with the output shaft or that these could comprise separate components connected together. Likewise it is envisaged that the output shaft may be integral with the cutting structure or that these could comprise separate components connected together.

It will be appreciated that the rotor and stator of the motor in each case are spaced radially outwardly of the rotational axis 10 of the rotor so as to define the access bore which may be used for whatever purpose required. The access bore allows unobstructed access to the cutting structure through the motor. This could be to enable access for a further cutting structure such as a narrower diameter drill bit or reamer shoe, or may be to enable access for a position sensing device or any other inspection or testing device as required.

The cutting structure driven by the motor could be a sacrificial cutting structure adapted to be, for example, drilled through when required.

It is envisaged that each apparatus 5, 21 could be used as part of an initial wellbore drilling operation prior to casing completion. In such an embodiment the stator of the motor 11 would be affixed to part of the drill pipe or string rather than the lowermost end 4 of the casing 3.

Each apparatus 5, 21 could also or alternatively be used during run in of the casing wherein a drill bit is located at the lowermost end of the casing so as to drill the wellbore during casing run in.

Figure 5:
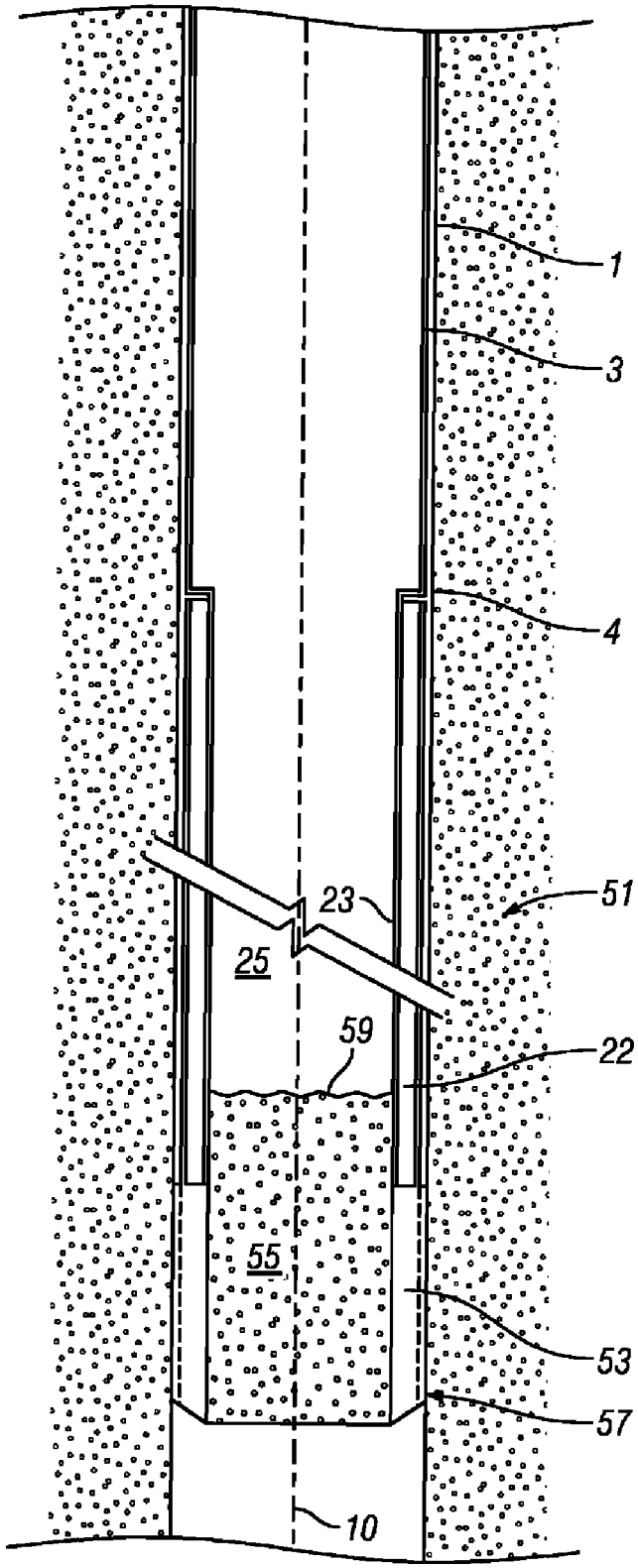
FIG. 5 is a sectional side view of a further apparatus in accordance with the present invention.

Referring additionally to FIG. 5 a further apparatus 51 is shown of similar structure to the apparatus 21 of FIGS. 2 and 4, namely a radially inner stator 23 and a radially outer rotor 22. However, in this embodiment, the cutting structure comprises an annular coring tool 53 rotatably driven by the rotor 22.

The annular coring tool 53 is hollow so as to define a through passage 55 that is contiguous in use with the access bore 25 defined in the stator 23.

In use, the outer and lower edge surface 57 of the coring tool 53 does the cutting, and the core 59 being cut, passes through the passage 55 and gradually progresses up the bore 25 of the stator 23 relatively undamaged and unbroken. The cutting fluid, which enters the motor 11 at the top via the aforementioned diverter 32, re-enters the access bore 25 generally radially inwardly (apart from some fluid leaking through bearings and/or seals to the external annular void 6), or extends down between the annular coring tool 53 and the stator 23 and exits radially outwardly into the annular void 6 through side passageways (not shown) formed through the coring tool 53.

This core 59 traversing up the bore 25 can be in excellent 'as cut' original condition and after passing retaining fingers in a casing shoe (not shown), can be pulled to the surface for examination.

The invention claimed is:

1. An apparatus for cutting a wellbore, the apparatus comprising a motor having a stator and a rotor, the rotor comprising an output shaft connected to a first cutting structure so as to drive the first cutting structure in use, wherein the stator and the rotor are formed to create an access bore that extends through the motor to a position adjacent the first cutting structure and through which, in use, a further object can pass through the stator and rotor, the further object comprising a second cutting structure, the motor access bore configured so as to enable passage of the second cutting structure toward the first cutting structure, such that the motor enable the second cutting structure access to the first cutting structure for drilling therethrough by the second cutting structure.

2. The apparatus of claim 1, wherein the access bore extends substantially the length of the motor.

3. The apparatus of claim 1, wherein the access bore is coaxial with the axis of rotation of the rotor.

4. The apparatus of claim 1, wherein the access bore extends across substantially 80% of the diameter of the apparatus, when the apparatus is viewed in transverse cross section, the motor thus being located in the radially outermost 20% of the apparatus.

5. The apparatus of claim 1, wherein the cutting structure is a sacrificial cutting structure, the further cutting structure operative to cut through the sacrificial cutting structure.

6. The apparatus of claim 1, wherein the further object further comprises a sensing device operative to transmit a signal indicative of at least one of the physical parameters of the cutting structure, the cutting process and the earth formation.

7. The apparatus of claim 1, wherein the motor is arranged so as to be entirely positioned, in use, and when viewed in transverse cross section, between the exterior of the access bore and the interior of the wellbore.

8. The apparatus of claim 1, wherein an outer margin of the motor is substantially flush with an outer margin of a tubular on which the motor is mounted in use.

9. The apparatus of claim 1, wherein the output shaft is integral with the cutting structure.

10. The apparatus of claim 1, wherein the output shaft is preferably concentric with, but radially outward of the stator.

11. The apparatus of claim 10, wherein the access bore is formed in the stator.

12. The apparatus of claim 1, wherein the output shaft is concentric with, but radially inward of the stator.

13. The apparatus of claim 12, wherein the access bore is formed in the output shaft.

14. The apparatus of claim 1, wherein the motor comprises a turbine arrangement comprising fluid engaging blades on at least the rotor to convert fluid flow through the motor into rotation of the rotor.

15. The apparatus of claim 14, wherein the motor is adapted to be driven using drilling fluid pumped down the wellbore.

16. The apparatus of claim 1, wherein the motor is adapted to be connected in use to a lower part of a drill string, the cutting structure comprising a drill bit.

17. The apparatus of claim 1, wherein the motor is adapted to be connected to a lower part of a casing, the cutting structure comprising a reamer shoe or a drill bit.

18. The apparatus of claim 1, wherein the second cutting structure comprises a coring tool operative to cut a core from the material being cut, the core removable from the wellbore through the access bore in the motor.

19. The apparatus of claim 18, wherein the coring tool is annular in structure, the coring tool comprising a through passageway that is contiguous in use with the access bore of the motor.

20. A method for cutting a wellbore, the method comprising rotating an output shaft of a rotor of a motor connected to a first cutting structure so as to drive the cutting structure into the earth to a desired depth, wherein a stator and rotor of the motor are formed to provide an access bore that extends through the motor to a position adjacent the cutting structure, and passing a further object through the access bore, the further object comprising a second cutting structure of the apparatus, the motor workings forming access bore so as to enable passage of the second cutting structure toward the first cutting structure, such that the motor enables the second cutting structure access to the first cutting structure through the access bore.

* * * * *